United States Patent [19]

Tran et al.

[11] 4,326,719

[45] Apr. 27, 1982

[54] ELECTRONIC MAZE GAME

[75] Inventors: Luan G. Tran, Redondo Beach; Timothy A. Effler, Torrance; Karen K. Wat, Hawthorne, all of Calif.

[73] Assignee: Mattel, Inc., Hawthorne, Calif.

[21] Appl. No.: 163,113

[22] Filed: Jun. 26, 1980

[51] Int. Cl.[3] ..... A63F 3/00

[52] U.S. Cl. ..... 273/238; 273/1 E; 273/138 A

[58] Field of Search ..... 273/237, 1 E, 85 G, 273/238, 138 A, 251, 252, 254, 255, 262, 265

[56] References Cited

U.S. PATENT DOCUMENTS 3,085,803 4/1963 Krzes ..... 273/238
3,874,671 4/1975 Smith ..... 273/254
4,057,253 11/1977 Csoka ..... 273/265 X
4,171,135 10/1979 Doyle et al. ..... 273/237
4,240,638 12/1980 Morrison et al. ..... 273/237

*Primary Examiner*—William H. Grieb
*Attorney, Agent, or Firm*—Reagin & King

[57] ABSTRACT

An electronic maze game having a housing containing control circuitry and supporting a matrix of position keys. When energized, the control circuitry generates a unique, invisible maze through which the players are required to proceed.

In a preferred embodiment of the invention, the control circuitry positions a treasure to be captured by the players within the maze and controls the movements of a monster which hunts the players during their progress through the maze.

9 Claims, 4 Drawing Figures

FIG. 1
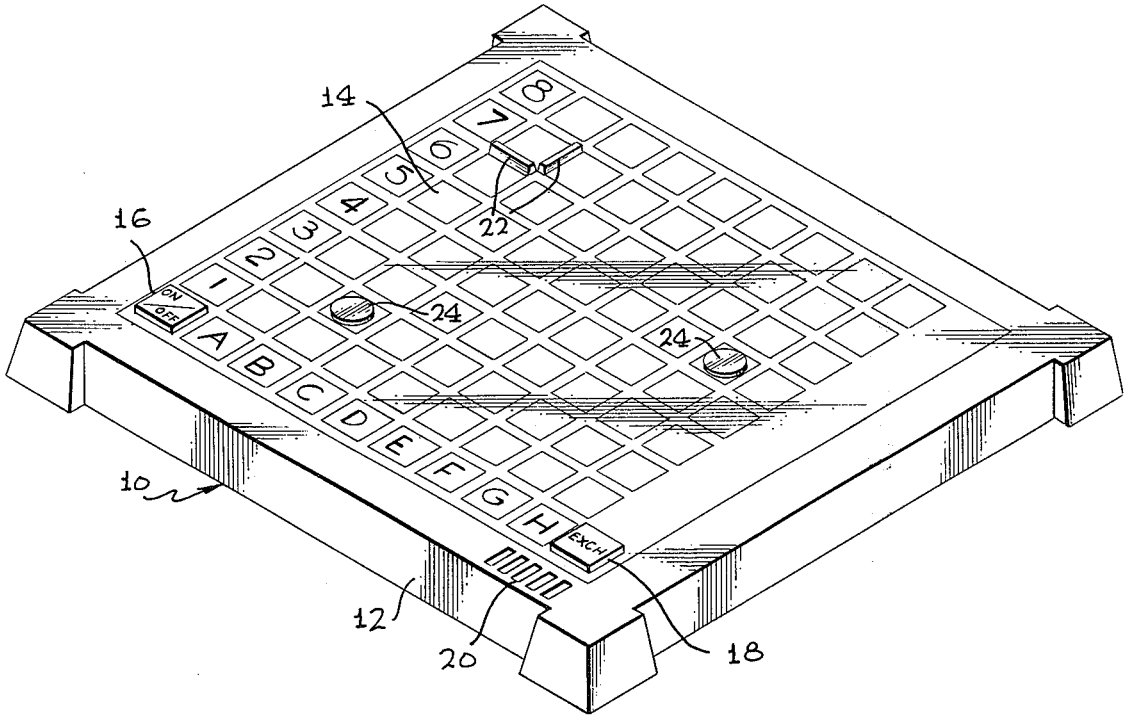
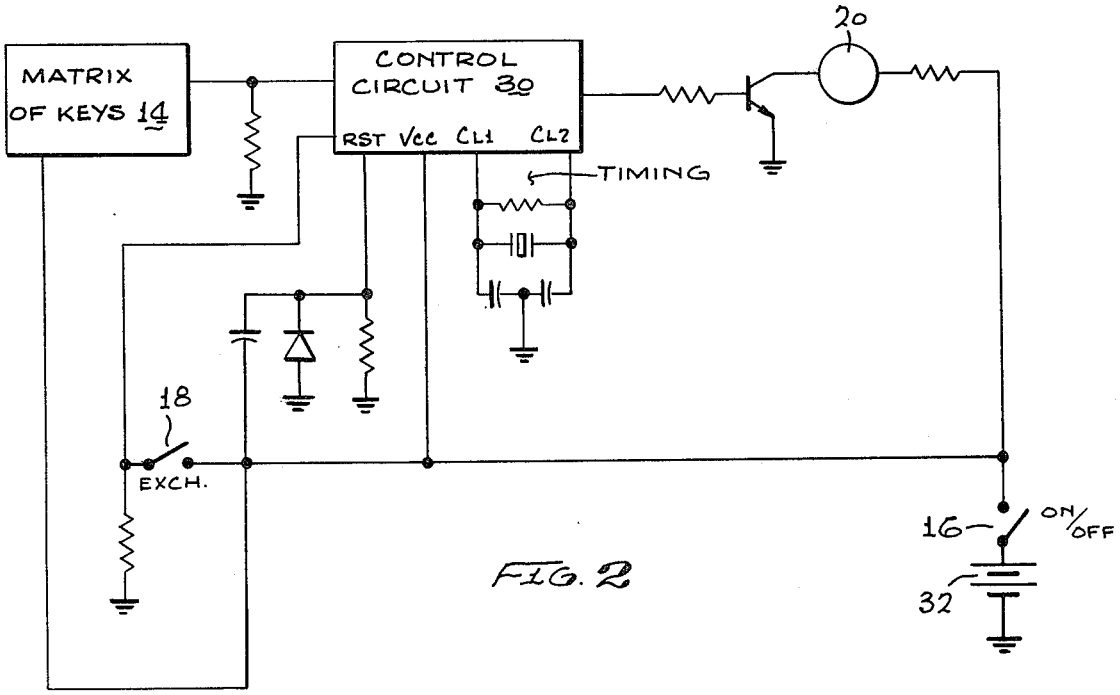
FIG. 2

STEP 122

ELECTRONIC MAZE GAME

This invention relates to games and, more particularly, to electronic maze games.

Maze games have a long history. Most such games are played with paper and pencil upon a preconstructed maze arrangement. The object of such a game is to work a player through the maze, usually in the smallest number of steps. Often these games are embellished by having an object of some theoretical value positioned within the maze which may be recovered by the first to reach the object. These games are usually played but once and discarded.

In addition to these simple paper and pencil games, maze games using a board and players are well known. Like the paper and pencil games, the board games offer a single or, at best, a limited selection of mazes through which the players work their respective ways.

Recent improvements in electronic semiconductor and computer circuitry have led to the construction of various electronic games. Such games often allow play by a number of operators and often offer more sophisticated play than is possible in the well known games of the past.

It is therefore an object of this invention to provide an electronic maze game.

It is another object of this invention to provide a maze game capable of providing the players with an essentially unlimited number of distinct maze arrangements upon which play may take place.

It is another object of this invention to provide a unique maze game which offers especially sophisticated features for the enjoyment of the players.

SUMMARY OF THE INVENTION

The foregoing and other objects of the invention are accomplished by an electronic maze game which has an exterior housing mounting a matrix of input keys each of which represents a position in a maze. The housing mounts internally microprocessor control circuitry which in response to indications keyed in by the players first constructs an unseen maze unique for each game from an essentially infinite variety of possibilities, next positions a treasure within the maze, and finally responds to input moves keyed into the matrix by the players to advance the players through the maze. In the preferred embodiment, the control circuitry provides sounds indicating when a player is to move, when a player has made a successful move, when a player has run into a wall of the maze, when a player has successfully reached the treasure, and when a player has won the game. The control circuitry of the preferred embodiment also automatically provides for the generation and control of an invisible monster which attempts to hunt down the players as they approach the treasure and retreat to their home sanctuaries with the treasure. An especially unique feature of the invention is that the maze is at no time shown to the players who must, consequently, grope through its passage initially and may only visualize the positions of its walls by memorizing or recording the steps they have taken in reaching any particular position.

Other objects, features, and advantages of the invention will become apparent by reference to the specification taken in conjunction with the drawings in which like elements are referred to by like reference designations throughout the several views.

BRIEF DESCRIPTION OF THE DRAWINGS

FIG. 1 is a perspective view of the exterior of a housing containing an electronic maze game constructed in accordance with the invention;

FIG. 2 is a block diagram of an arrangement of the electronic maze game of the invention.

DESCRIPTION OF THE PREFERRED EMBODIMENT

Figure 3A:
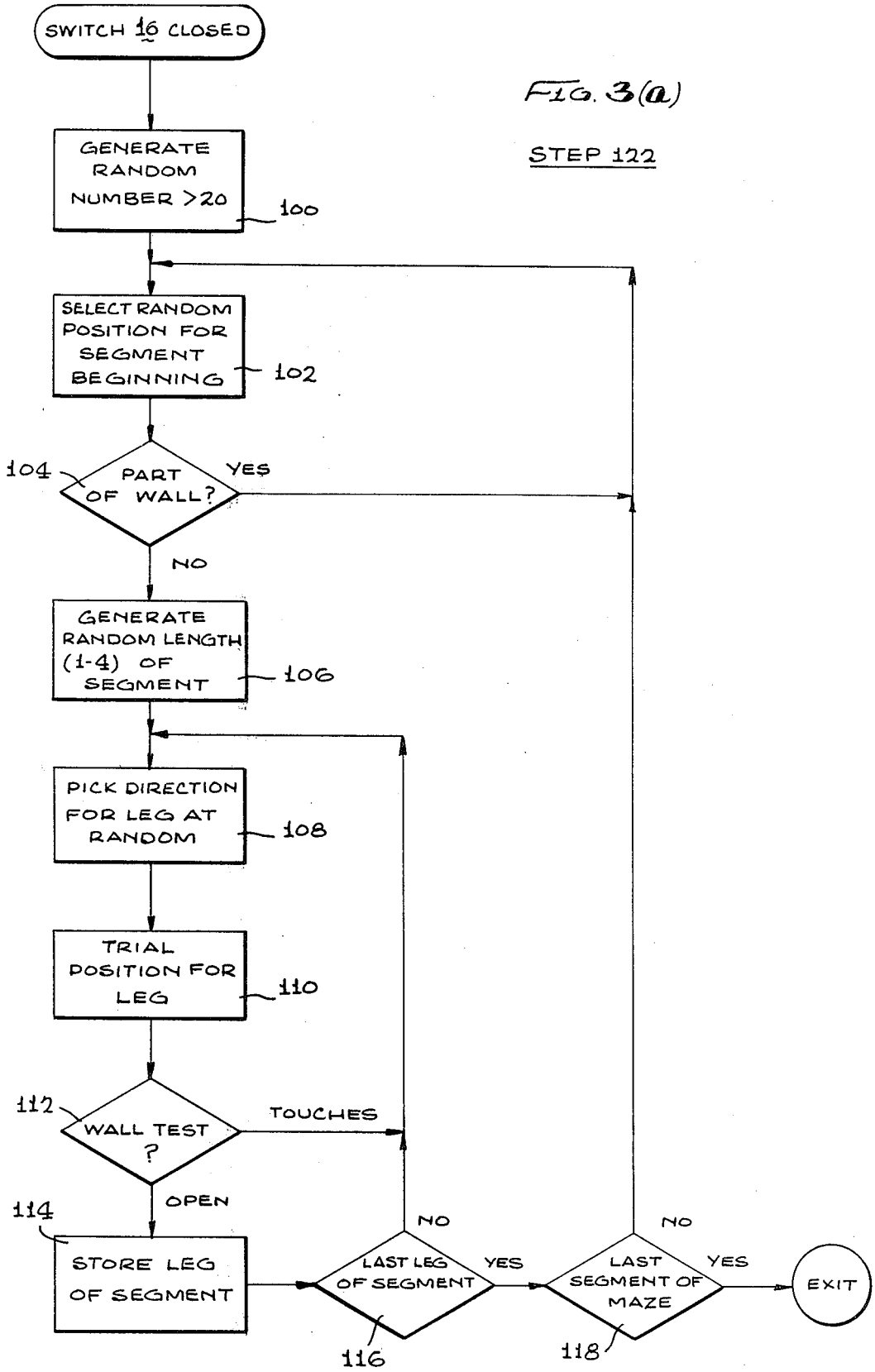
FIGS. 3(*a*)–3(*b*) together comprise a flow chart illustrating the sequence of operations performed by the circuitry of the electronic maze game of this invention.

Referring now to FIG. 1 there is shown a perspective view of an electronic maze game 10 constructed in accordance with the invention. The game 10 includes a housing 12 which may be constructed of a molded plastic material any number of which are well known to the prior art. The housing 10 supports on its upper surface a matrix of push button switches or keys 14. The keys 14 are shown in the arrangement of FIG. 1 in an eight by eight array and are identified by the numbers one through eight positioned in the column immediately to the left of the matrix and the letters A through H positioned in the row immediately below the matrix. A number and a letter uniquely define each of the keys 14 within the eight by eight matrix. For example, the key 14 in the lower left hand corner of the matrix is referred to throughout this specification as the key 14 in position 1A while the key 14 immediately to its right in the same lowest row is referred to as the key 14 in position 1B. In the preferred embodiment, each of the keys 14 is comprised of a switch which closes a contact when depressed and opens that contact when released. Other forms of switches might be used without departing from the teaching of this invention.

An off-on switch 16 is shown at the lower left hand corner of the upper surface of the housing 12. The switch 16 is used to provide power to switch on the game 10. A key 18 used for exchanging players (as will be explained hereinafter) is also positioned in the lower right hand corner of the upper surface of the housing 12.

The upper surface of the housing 12 also has positioned therein an opening for a speaker 20 which is connected to control circuitry (not shown in FIG. 1) which is positioned within the interior of the housing 12. The control circuitry positioned within the housing 12 is adapted to receive input signals initiated by players operating the keys 14, 16, and 18 and, inter alia, to translate those signals into output sounds produced by the speaker 20 which may be used by the players for playing the maze game 10. Also shown in FIG. 1 are movable walls 22 and playing pieces 24.

Positioned on the lower surface of the housing 12 (but not shown in FIG. 1) is an opening for providing batteries for operating the game 10.

Referring now to FIG. 2, there is shown a block diagram of a circuit which may be used in the preferred embodiment of the invention. The block diagram includes input switches 14, 16, and 18 and a speaker 20. The switches 14, 16, and 18 and the speaker 20 are each connected to a control circuit 30 which is shown in block form. A battery 32 is also connected to the circuit 30 by means of the switch 16. The battery 32 may be a nine-volt transistor battery in the preferred embodiment and is used to furnish power for operating the circuit 30.

As will be understood by those skilled in the art, the control circuit 30 may be implemented in any of a number of different ways. However, as with many prior art electronic game circuits, the preferred embodiment of the invention utilizes an integrated circuit microprocessor, a miniature digital electronic computer. Such integrated circuit microprocessors are well known and include all of the input, output, memory, logic, and control circuitry of a special purpose digital computer in miniature form. In general, such circuits have both random access memory (RAM memory) and read only memory (ROM memory). The ROM memory has connections formed by masking operations performed during the construction of the basic circuitry of the control circuit 30 to provide a completely wired circuit which includes the program for controlling operation of the microprocessor. Such an arrangement is often described as a dedicated memory circuit. The RAM memory of the circuit is utilized for storage of the various bits of transient information during the operation of the circuitry.

Various control circuits (such as the MicroCom-43 manufactured by NEC Microcomputers, Inc.) are offered by a number of manufacturers and are well known to the prior art. When a manufacturer is provided with the specifications for the game play to be accomplished, the manufacturer is able to provide the masks for causing the connections to be made so that the game may be played in accordance with the invention.

The game 10 is played in the following manner. When the on-off key 16 is depressed initially to turn on the game 10, the control circuitry 30 of the game 10 generates and stores in the RAM memory a particular maze which will be used on that play of the game 10. As will be understood from the description of the generation of the maze provided hereinafter, each maze generated will be in all probability different from any other maze previously (with the stipulation that there is a finite number of possible maze functions) or thereafter generated by the game 10. Consequently, it is impossible for the players to memorize the position of any of the walls in the maze except during the particular game. Consequently, the game will be different each time it is played. Furthermore, since the game 10 has no display, the maze is invisible; and the players operating the game are required to essentially feel their way through the course of the maze in order to reach their various destinations. A player may attempt to describe for himself the walls of the maze as these are encountered during play of the game either by memorizing the positions or by noting them on a piece of paper; or the players may agree to utilize pieces such as movable walls 22 shown in FIG. 1 to define the walls of the maze as these walls are encountered.

Each of the players (in the preferred embodiment, two players are involved) then selects an initial position by depressing a key 14 at a selected position on the matrix of the keys 14 and placing a playing piece 24 thereon. In the embodiment shown in FIG. 1, the two players have placed playing pieces 24 at positions 2B and 5G on the surface of the matrix of keys 14 supported by the housing 12. The initial position of each player becomes his starting position, his winning position, and a sanctuary where he is free from attack.

Upon receiving the input signals indicating the initial positions of the two playing pieces 24, the control circuitry 30 of the game 10 selects a position for a treasure. This position is not, however, indicated to the players; and the object of the game is for a player to locate the treaseure by placing his playing piece 24 at the position of the treasure and to return the treasure to his sanctuary. The treasure is located by the control circuitry 30 in a random position which is generally equidistant but at least four steps away from each of the sanctuaries of the players (disregarding the positions of the walls of the maze).

After the treasure has been positioned, the control circuitry 30 of the game 10 produces a sound by means of the speaker 20 selected to indicate to a first one of the players that he is to move his playing piece 24 in an attempt to locate the treasure. This sound is identified with that particular player and indicates his turn throughout the play of the game 10 unless the player successfully discovers the treasure. Each player has on each turn in the preferred embodiment of the invention the right to take moves totaling eight squares in the vertical or horizontal directions (up, down, right, left) if the player can do so without running into a wall of the maze.

Each move of eight squares by a player is made by depressing a series of keys 14 in order beginning with the old position of the player peice 24 and ending at the new position of the piece 24, (each key 14 being pressed lying immediately adjacent the key 14 last pressed). If the player runs into a wall of the maze as a key 14 is depressed, the speaker 20 is caused by the control circuitry 30 to buzz and the player's turn terminates at the last previous position of the matrix.

When a player hits a wall in the maze, the players are then able to memorize or otherwise record (as by use of the wall members 22) the position of that portion of the wall of the maze for use as the game progresses. In the preferred embodiment, the movable walls 22 may be positioned between the keys 14 to indicate a particular wall segment.

The termination of a move by one of the players causes the control circuitry 30 to generate a sound by means of the speaker 20 to indicate that it is the second player's turn to move. This sound (like that assigned to the first player) is unique to the second player and is played each time it is the second player's turn. The second player, like the first, may move his playing piece 24 over a total of eight squares in the vertical or horizontal direction (presuming that he does not encounter a wall of the maze) before his turn terminates.

The players continue alternating moves in response to sounds produced through the speaker 20 by the control circuitry 30 until one player comes within a distance of three or less squares of the treasure, the three squares being measured without reference to the walls of the maze on an absolute basis (that is, the sum of the vertical and horizontal distances). When any player approaches within three squares of the treasure, the control circuitry 30 causes a sound to be generated indicating that a monster guarding the treasure has been released from the position of the treasure and is attempting to hunt down the player. The monster moves one step vertically, horizontally, or diagonally toward the nearest player on each turn; and the monster takes its turn, once released, after each player's move. The monster is not limited by the walls of the maze and may cross over the walls. However, when the monster flies over a wall, the speaker 20 produces a flying sound, while when the monster walks through an open passage the speaker 20 produces a walking sound. These sounds may be used by perspicacious players to determine the position of wall segments and of the monster. If the monster lands upon a player's position or a player lands upon the monster's position, the player is bitten by the monster, the speaker 20 produces a sound emulating a scream, and the player is returned to his sanctuary. After a player has been bitten once, he can move a maximum of only six squares per turn. After a player has been bitten twice, he can move only four squares per turn. After a player has been bitten a third time or if a player is bitten while carrying the treasure, the player dies and is out of the game. In such a case a tune signifying death is produced. If a player is bitten and returns to his sanctuary, his play progresses from that point on the next turn.

In order for any player to win the game (including the only player remaining in the game after the other player has been killed), he must capture the treasure and return it back to his sanctuary. A player captures the treasure by landing on its position. When a player lands on the position containing the treasure, a happy tune is sounded by the speaker 20 to indicate to the player that he has captured the treasure. An opponent may capture the treasure from a player who has himself captured the treasure by landing on the same square as the player with the treasure. If the opponent does so, he takes the treasure and continues his move back toward his sanctuary being pursued thereafter by the other player.

In a preferred embodiment of the invention any player may enter a sanctuary whether his own or that of his opponent. However, if a player passes into the opponent's sanctuary with the treasure, the opponent wins; and a winning tune is sounded by the speaker 20. A dragon cannot enter into any sanctuary; and, consequently, any player in a sanctuary is free from attack by a dragon.

The key 18 shown in FIG. 1 is used by a player who wishes to terminate his move before eight spaces. By depressing the key 18, the turn is switched to the next player or to the monster.

Figure 3B:
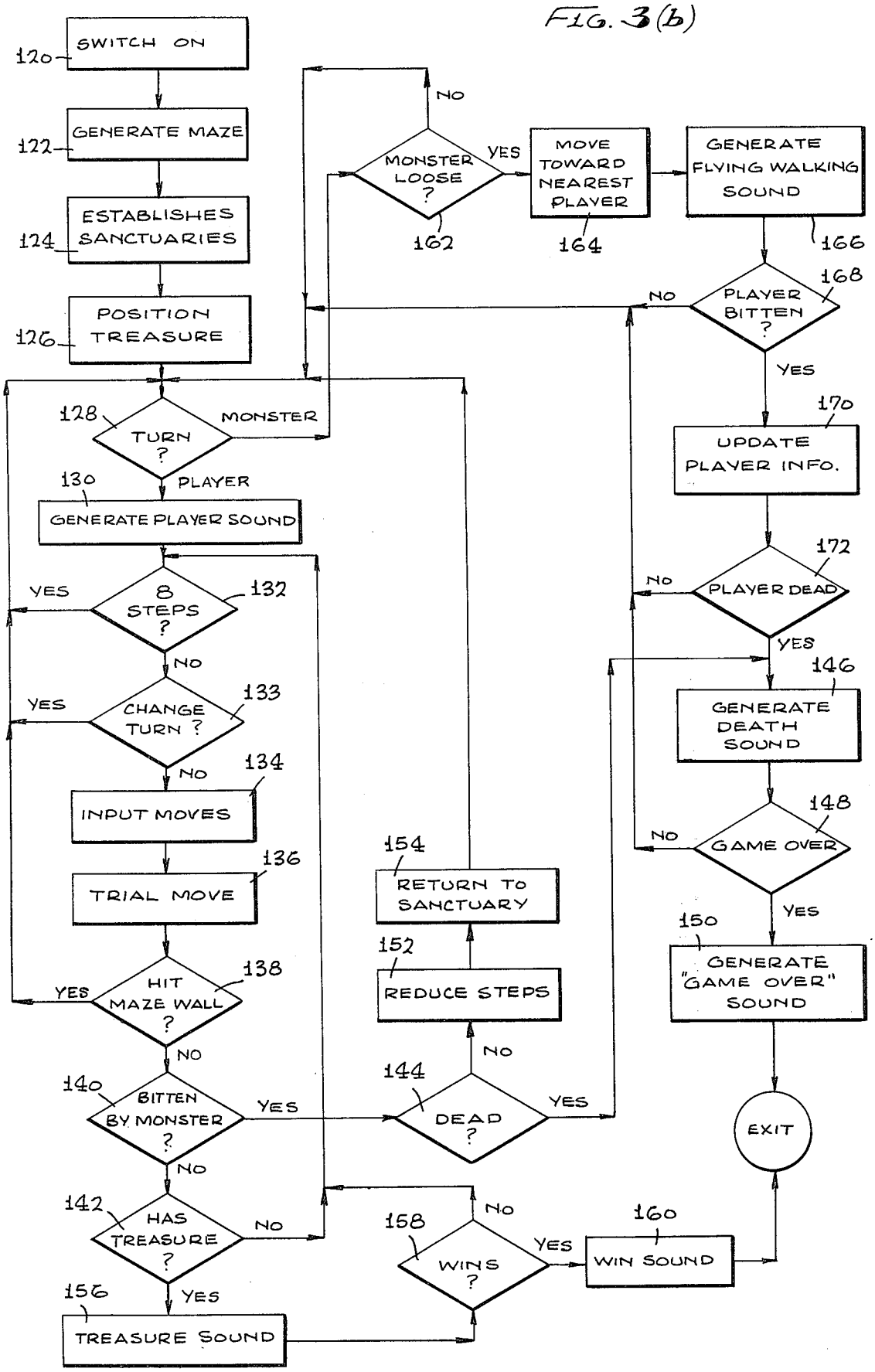

Illustrated in FIG. 3(*a*) is a flow chart which describes the operation of the control circuit 30 in establishing a maze when the game 10 is initially energized. The flow chart is entered at a decision step 100 after the switch 16 has been closed. As soon as the switch 16 has been closed, the program moves to step 100 in which a random number greater than twenty is generated in the preferred embodiment. This random number is utilized for generating the segments of the walls of the maze and is equal to the number of segments of walls. A number greater than twenty is utilized because this is the minimum determined pragmatically which will construct a maze overlaying an eight by eight matrix of positions sufficient to provide an interesting game.

Although the number of positions shown in the matrix of the keys 14 is sixty-four, it has been found useful in the preferred embodiment of the invention to consider each position of the matrix keys 14 as separated from the next position by a position which may or may not be filled by a wall segment. Thus the positions of the players and of the walls of the maze may be stored in approximately a sixteen by sixteen matrix of RAM memory. With such an arrangement, all that is necessary to test to determine whether a player has run into a wall of the maze is to test the position adjacent to the player to see whether it is filled by a wall.

The program moves from the step 100 in which a random number greater than twenty is generated to a step 102 in which a random position is selected for the beginning of the matrix. This position may be at any corner separating four player positions. For example, referring to FIG. 1, the position for the beginning of the maze may be that between the four player positions 2A, 2B, 1A, and 1B.

When the initial position for the first segment of the maze has been selected, this position is tested at a step 104 to see if it is already a part of the wall of the maze. If it is (as when other portions of the matrix have already been generated), the program recirculates to step 102 to select another position for the beginning of the matrix and tests at step 104 whether this position is already part of the wall. If the position is not already part of the maze wall, the program moves to a step 106 in which it generates at random a number between one and four which is used as the length of the particular segment of the maze wall being generated. When this number has been selected, the program moves to a step 108 to pick a direction at random (up, down, right, left) to proceed in drawing the first leg of the segment of the maze wall.

The program next proceeds to a step 110 in which a trial position for the leg of the segment is attempted and to a decision step 112 at which it is determined whether this leg of the wall touches any other portion of the wall or the boundaries of the matrix. If the new portion of the wall touches any other portion of the wall of the matrix, it is possible to close a square and thereby exclude a position of the playing field from play or entrap either the treasure or one of the players. Since this is undesirable, if the wall leg touches another portion of the wall of the matrix, the program recirculates to the step 108 to pick another direction at random from the initial position of the segment for attempting to establish a leg of the wall of the maze.

If the trial position of the leg of the wall does not touch another wall of the maze (except at its beginning point), the program moves to a step 114 in which the leg of the wall for which the trial has been run is established and stored in the RAM memory.

The program then moves to a decision step 116 in which it is determined whether this is the last leg of the particular segment of the wall. If the particular segment is to be more than one leg long and more legs are still to be established, the program recirculates to step 108 to pick another direction at random from the most forward position of the now established leg of the wall and to move through the program as explained above.

If this is the last leg of the particular segment of the wall, the program moves to a decision step 118 in which it is determined whether this is the last of the segments to be established for the particular maze. This is determined based on the random number of segments generated initially at the step 100 in determining the size of the maze. If this is not the last segment of the maze to be generated, the program recirculates to the step 102 to select at random another position for beginning another segment of the maze. The program then proceeds as explained above. In this manner, the entire maze is generated until at step 118 it is determined that this is the last segment of the maze to be generated, and the program exits the sub-routine.

The flow chart shown in FIG. 3(*b*) illustrates the steps of the program in the preferred embodiment of the invention in accomplishing the play of the game 10. The program is entered at a step 120 with the closing of the switch 16 and proceeds to the step 122 where the generation of the maze as explained above with regard to FIG. 3(*a*) takes place. The program then proceeds to a step 124 in which the initial positions or sanctuaries of the players are established by depressing the selected ones of keys 14.

The program next moves to a step 126 in which the position of the treasure is generated by the control circuitry 30 and stored in the RAM memory. It will be recalled from the explanation above that the position of the treasure is selected to lie approximately equidistant from each of the two positions established for the sanctuaries of the players. Consequently, the program measures the distance between the two players, selects a mid point, and at random selects a position which lies essentially midway between the two sanctuaries but at least four steps from each.

The program next moves to a decision step 128 in which it is determined whose turn it presently is. In the control circuitry 30, there are three players, player one, player two, and the monster. Player one is the first to have established his sanctuary. In the normal order of play, player one plays first. The monster plays second under direction of control circuitry 30, player two plays next, and the monster plays again. This order of play continues throughout the game. If a player is bitten and dies however, both his turn and the monster's turn which follows are thereafter ignored.

Since player one is to play first, the program then moves to a step 130 in which the sound is generated indicating that the turn is that of player number one. The program moves from the sound generation step 130 to a step 132 in which it is determined whether this player has already taken eight steps in his move. If he has, the program recirculates to step 128 to determine which player should next move. If the player has not taken eight steps, the program moves to a step 133 at which it is determined whether the exchange key 18 has been closed. If it has been closed, the program recirculates to the step 128 to determine which player's turn comes next.

If the exchange key has not been depressed at step 133, the program moves to a step 134 at which the move of the player made by depressing one of the keys 14 is stored in memory. The program next moves to a step 136 in which the move is attempted on a trial basis. The program moves from the step 136 to a decision step 138 in which it is determined whether the trial move causes the player to hit a wall of the maze or not by testing the adjacent position in the RAM memory. If the player hits the wall of the maze, the program recirculates to the decision step 128 at which it is determined which player's turn is next and the turn of the present player terminates.

If the player does not hit the wall of the maze, the program moves to a step 140 in which it is determined whether the player has moved onto a position occupied by the monster and has, thus, been bitten by the monster. If this has not occurred, the program moves to a step 142 in which it is determined whether the player is carrying the treasure. If the player does not have the treasure, the program recirculates to await the next step in the move by the present player. It will be recalled that in the play of the game it is necessary to indicate each step of each move by any individual player in making his move. That is, if a player moves from position 2B shown in FIG. 1 to position 3D through the intervening positions 3B and 3C then each of the keys 14 at each of the positions 3B, 3C, and 3D must be depressed in order. Consequently, any move by a player will require a number of individual depressions of keys 14 and the program will recirculate for each of those depressions.

If the player at step 140 has landed on a position occupied by the monster and has thus been bitten, the program moves to a decision step 144 in which it is determined whether the player dies or not from the bite. It will be recalled that if this is either the third bite for that player or if that player carries the treasure and is bitten, he dies. If the player dies, the program moves to a step 146 to generate a death sound and then to a decision step 148 in which it is determined whether the game is over or not. The game is over if no players remain alive. If the game is over when the player dies, the program moves to a step 150 to cause the speaker 20 to generate a "game-over" sound. The program then exits the routine. If a player remains and the game is consequently not over, the program recirculates to the step 128 to determine whose turn is next.

If at the step 144 the player has not died, the program then moves to a step 152 to reduce the number of steps that the player may take in any move from eight to six of from six to four. The program then moves to a step 154 to return the player to his sanctuary and then to the step 128 to determine which player's turn is next.

If the player at step 142 has the treasure, then the program moves to a step 156 to change the sound for the player to a treasure sound and then moves to a decision step 158 at which it is determined whether the game has been won. The game is won when the player returns to his sanctuary with the treasure. If this is not the case, the program recirculates to the step 132 and continues with the player's move. If the player is in his sanctuary with the treasure at the step 158, then the program moves to a step 160 to cause the speaker 20 to emit a win sound and exits the sub-routine. If the player is in the opponent's sanctuary at step 158, a win sound is generated at step 160 for the opponent.

It should be understood that a player is found to have the treasure at step 142 if he has landed on the position occupied by a player who holds the treasure. In such a case, the treasure sound will be associated with the new capturing player at the step 156.

If at the decision step 128 at which it is determined which player's turn it is, the program determines that it is the monster's turn, the program moves to a decision step 162 in which it is determined whether the monster is free to move or not. As explained above, the monster is free to move when a player approaches within three squares of the treasure in absolute distance. Consequently, at step 162 it is determined whether the monster has already been released or if any player is within three squares of the treasure in absolute distance by measuring the vertical and the horizontal distances between each player and the treasure and adding those distances. If the monster is not already loose and no player is in such a position, the program recirculates to the decision step 128 without freeing the monster.

If at the step 162 a player is within three spaces of the treasure, the program moves to a step 164 in which the vector toward the nearest player is computed, and the monster is moved toward that player. The moves of the monster are computed so that the monster moves directly toward the player if the player is on either a direct horizontal or a direct vertical line and moves diagonally if the player is at any diagonal from the monster.

The program then moves to a step 166 to generate sounds indicating that the monster is flying over a wall or is stepping through an opening in the wall of the maze. This is accomplished by looking at the positions of the maze in the RAM memory to determine whether there is a wall between the positions in which the monster is at the beginning of the move and at the end of the move. If such a wall exists, the flying music is generated. If no such wall exists, the stepping music is generated.

The program then moves to a step 168 at which it is determined whether a player is at the monster's new position and has been bitten. If no player has been bitten at the step 168, the program recirculates to the step 128 to determine which player has the next turn. If a player has been bitten at the step 168, the program moves to a step 170 in which data regarding bites suffered by each player is updated, the number of steps per move for that player is reduced, and the player is returned to his sanctuary.

The program then moves to a decision step 172 to determine whether the player has died of his last bite. If the player has not died, the program moves to the decision step 128 in which the next player is determined. If the particular player has died, the program moves to the step 146 to cause the speaker 20 to generate the death sounds and to the decision step 148 to determine whether the game is over based on the criteria explained above. If the game is over, the program moves to the step 150 to cause the speaker 20 to generate the sounds indicating the game is over and exits the routine. If the game is not over at step 148, the program recirculates to the decision step 128.

The game proceeds as explained above with respect to the flow chart until both players have either died or a player has returned with the treasure to a sanctuary. The game is then reset by turning off and then on the switch 16 to regenerate a new maze.

As will be understood by those skilled in the art, many different programs may be utilized to implement the flow charts disclosed in this specification. Obviously, these programs will vary from one another in various degrees. However, it is well within the skill of the art of the computer programmer to provide particular programs for implementing each of the steps of the flow charts disclosed herein. It is also to be understood that various microcomputer circuits might be programmed for implementing each of the steps for the flow chart disclosed herein without departing from the teaching of the invention. In addition, although a particular embodiment of the game using sounds to convey information has been disclosed, other embodiments may be visualized. For example, another control circuit might use words to signal the operator.

It is, therefore, to be understood since various embodiments might be devised by those skilled in the art without departing from the spirit and scope of the invention, it is the intention of the inventors to be limited only by the scope of the claims appended hereto.

What is claimed is:

1. An electronic maze game comprising a plurality of switches representing positions on a rectangular field; and circuit means responsive to the switches for controlling the operation of the game, the circuit means including means for establishing and storing the structure of an invisible maze on the field, means for responding to closure of the switches to establish initial and succeeding player positions on the field, means for indicating to a player when his path on the field is obstructed by the maze, and means for randomly designating a position on the rectangular field as containing an invisible treasure.

2. An electronic maze game comprising a plurality of switches representing positions on a rectangular field; and circuit means responsive to the switches for controlling the operation of the game, the circuit means including means for establishing and storing the structure of an invisible maze on the field, means for responding to closure of the switches to establish initial and succeeding player positions on the field, means for indicating to a player when his path on the field is obstructed by the maze, means for designating a position on the rectangular field as containing a treasure, and means for generating an indicia of a monster to protect the treasure and for directing the indicia of the monster to intercept players attempting to capture the treasure.

3. An electronic maze game as in claim 2 in which the circuit means further comprises means for designating positions upon the field as forbidden to the monster.

4. A portable electronic game comprising a microprocessor constructed to provide means for generating a maze connecting and separating positions on a playing field which maze varies in structure each time the game is energized, and means for randomly positioning an invisible treasure within the maze in response to initial positions of players; and means for providing input signals to the microprocessor for indicating the position of players.

5. A portable electronic game comprising a microprocessor constructed to provide means for generating a maze connecting and separating positions on a playing field which maze varies in structure each time the game is energized, means for positioning a treasure within the maze in response to initial positions of players, means for generating indicia of a monster, and means for controlling the monster to attempt to intercept players; and means for providing input signals to the microprocessor for indicating the position of players.

6. A portable electronic game as in claim 5 including means for generating sounds in response to input signals and the action of the monster.

7. A portable electronic game as in claim 6 in which the microprocessor is constructed to end a player's turn in response to an input signal from the player, and further comprising means for providing an input signal to the microprocessor to indicate the end of a turn.

8. A portable electronic game comprising a plurality of input keys arranged in a matrix defining positions on a field, an on-off key, an exchange key, means responsive to the on-off key for defining a maze on the field connecting certain of the positions and separating others of the positions, means responsive to a first closure of one of the input keys to select a beginning position for a first player, means responsive to a first closure of another of the input keys to select a beginning position for a second player, means responsive to closure of input keys after the selection of the beginning positions for moving a player to the position indicated by the key, means for indicating to a player when he encounters the maze and for terminating the player's move at that point, means for randomly selecting a position on the field for an invisible treasure, and means for associating the treasure with a player landing on the position of the treasure.

9. A portable electronic game comprising a plurality of input keys arranged in a matrix defining positions on a field, an on-off key, an exchange key, means responsive to the on-off key for defining a maze on the field connecting certain of the positions and separating others of the positions, means responsive to a first closure of one of the input keys to select a beginning position for a first player, means responsive to a first closure of another of the input keys to select a beginning position for a second player, means responsive to closure of input keys after the selection of the beginning positions for moving a player to the position indicated by the key, means for indicating to a player when he encounters the maze and for terminating the player's move at that point, means for selecting a position on the field for a treasure, means for associating the treasure with a player landing on the position of the treasure, means for providing indicia of a monster, and means for causing the monster to intercept players attempting to procure the treasure.

* * * * *